US011071684B2

(12) United States Patent
Thirunavukarasu et al.

(10) Patent No.: US 11,071,684 B2
(45) Date of Patent: Jul. 27, 2021

(54) SHAKING DEVICE, SYSTEM, AND METHOD

(71) Applicant: Health Research, Inc., Buffalo, NY (US)

(72) Inventors: Pragatheeshwar Thirunavukarasu, Buffalo, NY (US); Joseph Skitzki, Buffalo, NY (US)

(73) Assignee: Health Research, Inc., Buffalo, NY (US)

( * ) Notice: Subject to any disclaimer, the term of this patent is extended or adjusted under 35 U.S.C. 154(b) by 1057 days.

(21) Appl. No.: 15/306,547

(22) PCT Filed: Apr. 27, 2015

(86) PCT No.: PCT/US2015/027826
§ 371 (c)(1),
(2) Date: Oct. 25, 2016

(87) PCT Pub. No.: WO2015/164876
PCT Pub. Date: Oct. 29, 2015

(65) Prior Publication Data

US 2017/0042761 A1 Feb. 16, 2017

Related U.S. Application Data

(60) Provisional application No. 61/984,509, filed on Apr. 25, 2014.

(51) Int. Cl.

| | |
|---|---|
| ***A61H 23/00*** | (2006.01) |
| ***A61H 23/04*** | (2006.01) |
| ***A61H 23/02*** | (2006.01) |
| *A61H 11/00* | (2006.01) |

(52) U.S. Cl.
CPC ..... *A61H 23/04* (2013.01); *A61H 23/00* (2013.01); *A61H 23/02* (2013.01); *A61H 23/0254* (2013.01); *A61H 2011/005* (2013.01); *A61H 2201/0134* (2013.01); *A61H 2201/0142* (2013.01); *A61H 2201/1619* (2013.01); *A61H 2201/1623* (2013.01); *A61H 2201/5046* (2013.01); *A61H 2201/5071* (2013.01); *A61H 2201/5082* (2013.01); *A61H 2201/5087* (2013.01)

(58) Field of Classification Search
CPC ..... A61H 23/04; A61H 23/02; A61H 23/0254
See application file for complete search history.

(56) References Cited

U.S. PATENT DOCUMENTS

| | | | | |
|---|---|---|---|---|
| 4,949,712 | A | 8/1990 | Torii | |
| 5,490,820 | A | 2/1996 | Schock et al. | |
| 6,174,295 | B1 | 1/2001 | Cantrell et al. | |
| 7,229,423 | B2 | 6/2007 | Horzewski et al. | |
| 10,245,207 | B2 * | 4/2019 | Avni | A61H 9/0092 |
| 2004/0153009 | A1 | 8/2004 | Horzewski et al. | |
| 2006/0185083 | A1 * | 8/2006 | Sackner | A61H 1/006 5/109 |
| 2008/0097562 | A1 | 4/2008 | Tan | |
| 2012/0016280 | A1 | 1/2012 | Aliverti et al. | |

* cited by examiner

*Primary Examiner* — LaToya M Louis
(74) *Attorney, Agent, or Firm* — Hodgson Russ LLP

(57) ABSTRACT

A shaking device includes at least one pad, a mover configured to reciprocally move the pad, and a mount configured to support the mover. The shaking device may be connected with a medical device using a feedback system. The shaking device may be configured to change settings based on readings from the feedback system.

8 Claims, 6 Drawing Sheets

SHAKING DEVICE, SYSTEM, AND METHOD

CROSS-REFERENCE TO RELATED APPLICATIONS

This application claims priority to U.S. Provisional Application No. 61/984,509, filed on Apr. 25, 2014, the disclosure of which is incorporated herein by reference.

FIELD OF THE DISCLOSURE

The disclosure relates to shaking devices used during medical procedures.

BACKGROUND OF THE DISCLOSURE

Peritoneal carcinomatosis is a condition characterized by the presence of multiple cancer nodules throughout the abdominal cavity. One treatment for peritoneal carcinomatosis is surgical removal of all visible tumors or tumor-studded organs followed by perfusion of the abdominal cavity with fluid containing chemotherapeutic drugs. After all visible tumors are removed by the surgeon, inflow and outflow catheters are placed in the abdominal cavity. These catheters are connected to a bypass perfusion machine. Chemotherapeutic drugs are added to the fluid in the bypass circuit, flushed into the abdominal cavity through the inflow catheters, and then directed back from the abdominal cavity through the outflow catheters. This flushing of the abdominal cavity with the chemotherapeutic drugs may be performed for approximately 90 to 120 minutes. During the flushing procedure, a surgeon manually shakes the abdominal cavity to ensure a proper circulation of the drug to all parts of the abdominal cavity. This action of constant shaking prevents fluid from collecting in parts of the abdominal cavity, such as spaces between organs. The surgeon may need to shake at a constant speed and consistent force so that the flow through the bypass circuit is constant. After this approximately 90 to 120 minutes of shaking, the catheters and chemotherapy-containing fluid are removed, and the surgeon continues the procedure to reconstruct the resected organs as needed. The entire operation typically takes several hours. For example, the entire operation may take more than approximately 6 hours or even more than approximately 10 hours.

Shaking the abdomen for approximately 90 to 120 minutes with constant force at constant speed can be a difficult task for a surgeon. It may not be possible to objectively assess the force and speed of shaking the abdominal cavity. The desired or optimal speed and force varies from individual to individual depending on the individual's body habitus. Furthermore, the shaking procedure results in surgeon fatigue, which may result in altered speed, altered force, interruptions, or irregularity during the shaking.

Therefore, what is needed is a device for shaking a human body at a desired force and speed that can be adjusted. More particularly, what is needed is a device for shaking the abdomen at a desired force and speed that can be adjusted.

BRIEF SUMMARY OF THE DISCLOSURE

The shaking device is used to shake parts of the human body or an entire human body. This shaking device may be used during the instillation of drugs into body cavities. For example, the device may be used in shaking the abdominal cavity during perfusion of the abdominal cavity with chemotherapeutic drugs. This may occur in an operating room or outside an operating room. The device enables safe, constant, regular, or rhythmic shaking that can, for example, facilitate uninterrupted flow of chemotherapeutic drugs.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this invention. Various structural, logical, process step, and electronic changes may be made without departing from the spirit or scope of the invention. Accordingly, the scope of the invention is defined only by reference to the appended claims.

The shaking device disclosed herein is used to shake parts of the human body or an entire human body, such as during installation of drugs into body cavities. This shaking may include, for example, pressing, pushing, or otherwise agitating. For example, the device may be used for shaking the abdominal cavity during perfusion of the abdominal cavity with chemotherapeutic drugs. However, the shaking device can be used during other procedures or surgeries where the individual's body is shaken. In some embodiments, the term "shaking" should be construed broadly to include any type of movement of the body, or portion of the body, of the individual.

Figure 1:
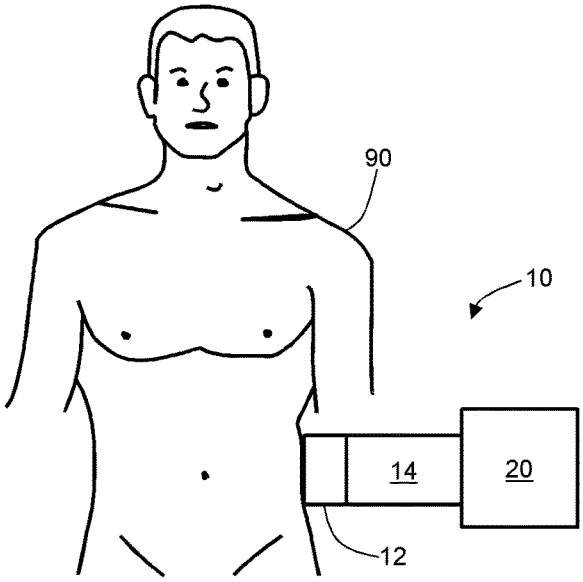
FIG. 1 is a schematic view of a shaking device relative to an individual.

FIG. 1 is a schematic view of an embodiment of a shaking device 10 relative to an individual 90. The shaking device 10 includes at least one pad 12, a mover 14 configured to reciprocally move the at least one pad 12 and a mount 20 configured to support the mover 14 and/or the pad 12. In an example, the shaking device 10 includes one or more pads 12 that are held in position (relative to the body of the individual 90) by a mount 16. The motion of the pads 12 is provided by a mover 14. The force, rhythm, stroke length, direction, or speed (extending and retracting) of the movements are controlled by a controller 20. Various supports or brackets can be used as the mount 16 to hold the components of the shaking device 10.

A shaking device according to the present disclosure may be connected to another medical device through a feedback system. For example, the shaking device 50 may be connected with a bypass perfusion 60 machine used for chemotherapy treatment (see, e.g., FIG. 6). The input flow, output flow, fluid temperature, or other readings may be measured by sensors 62 of the bypass perfusion machine 60. Based on one or more of these readings, the shaking device 50 may adjust its force, rhythm, stroke length, speed, and/or other parameters. For example, a decrease in output flow may indicate that the outflow catheter is obstructed. The shaking device may respond to such a decrease by altering the speed, rhythm, etc. of movement. Such a change in movement may remedy the decrease in flow by, for example, dislodging an obstruction.

FIG. 1 is a schematic view of a shaking device 10 relative to an individual 90. In this example, the pad 12 moves toward and away from the side of the individual 90 (i.e., along a mediolateral axis) to generate a shaking motion on part of the individual 90. In this example, the pad applies force to the individual's abdomen, though force can be applied elsewhere to the individual.

The mount may be a bracket configured to attach the shaking device to a frame of a hospital bed or operating bed. Alternately, the shaking device may include, or be attached to, an independent frame beside the individual, hospital bed, or operating bed. The bracket or frame can be adjustable in the horizontal, vertical, or angular directions. Thumb screws, quick release clamps, or other components may be used for ease of attachment or adjustability. One or more shaking devices may be attached to a single bracket or frame.

The pad 12 may be comprise a cushion or other soft pad to provide a soft touch to the individual 90.

Figure 7:
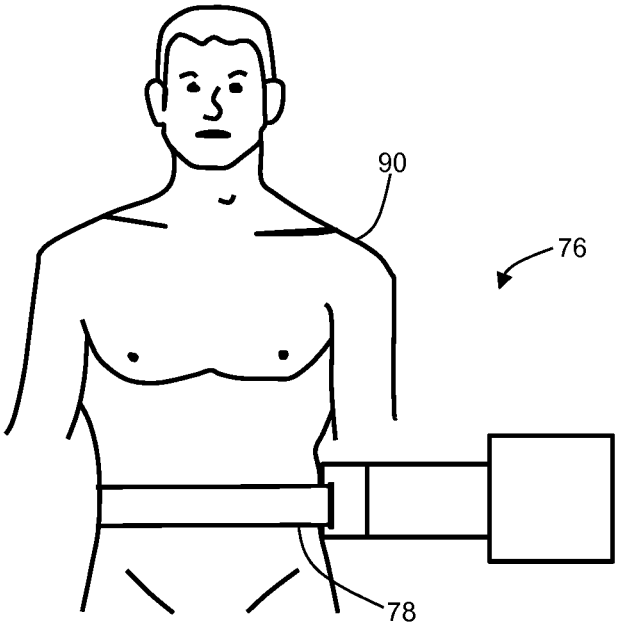
FIG. 7 is a schematic view of a shaking device according to another embodiment of the present disclosure.

In another example (see, e.g., FIG. 7), a shaking device 76 according to an embodiment of the present disclosure is held to the body of an individual 90 using one or more straps 78, for example, straps 78 wrapped around the individual 90. For instance, a first end of a strap can be attached to the rails of the bed and a second end can be wrapped over or around the individual and attached to the first end with a system such as Velcro, buckles, or other systems known to those skilled in the art.

One or more shaking devices can be used on an individual, which may be attached to one or more brackets, standing frames, or other fixation components. If more than one shaking device is used on an individual, the shaking devices can be energized in a synchronized fashion or independently, or any other way suitable for the desired result.

The mover of the shaking device(s) can include, for example, an actuator such as a slide actuator, cylinder actuator, rotary actuator, a contracting device like a bellows, or other devices known to those skilled in the art. In embodiments with more than one mover, such components can be used in combinations, for example, a bellows and a slide actuator. The shaking device can be actuated using pneumatic, electric, vacuum, hydraulic, or other sources available in an operating theater or medical setting.

Figure 2:
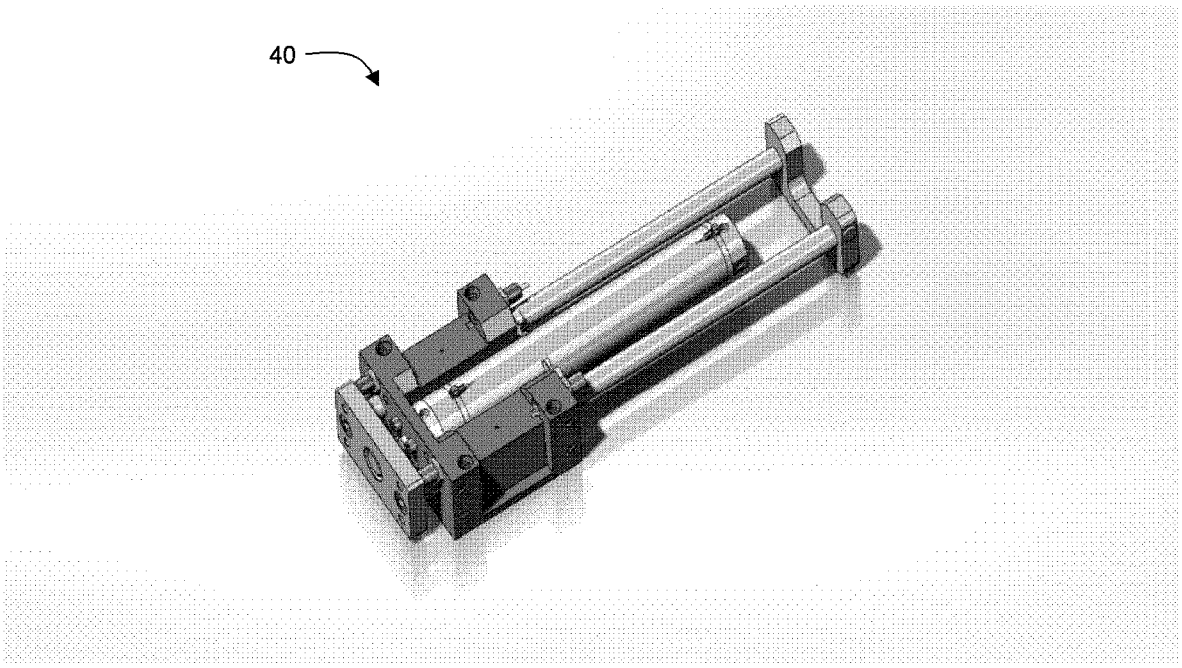
FIG. 2 is an orthogonal view of a slide actuator configured for use in a shaking device.
Figure 3:
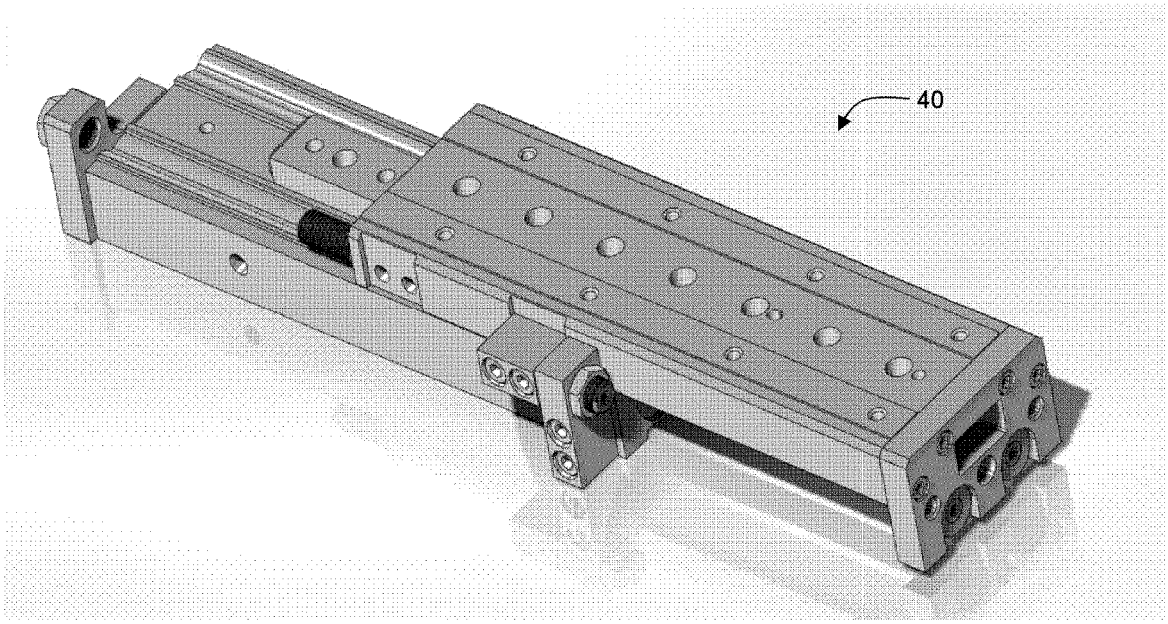
FIG. 3 is another orthogonal view of the slide actuator of FIG. 2.

FIGS. 2 and 3 are top and bottom views of a slide actuator 40 configured for use in an exemplary shaking device. The slide actuator 40 can be used in the shaking device to shake the individual. The slide actuator may be pneumatically energized or otherwise energized. Such a slide actuator may have a stroke length which, in some embodiments, can be adjusted by sliding a mechanical stop. In other embodiments, the stroke length may vary according to the pneumatic (or other) actuation force. Extending and retracting speeds can be adjusted with flow control valves attached to both ends of the slide actuator. Shock absorbers may be included to provide a smooth stop at both ends of travel.

Figure 4:
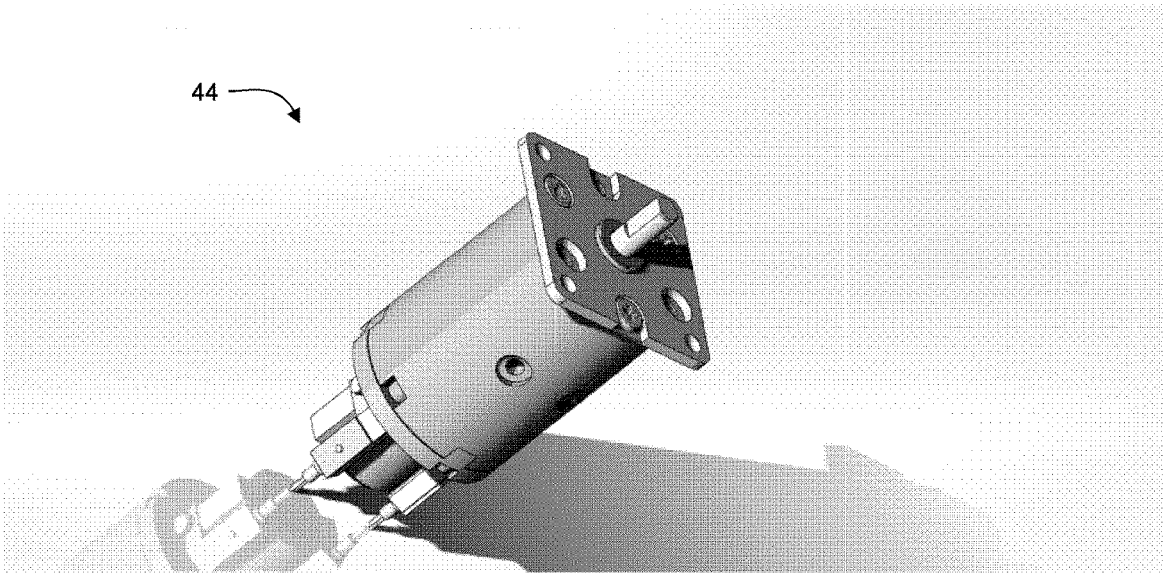
FIG. 4 is an orthogonal view of a rotary actuator configured for use in a shaking device.

FIG. 4 is a view of a rotary actuator 44 configured for use in another exemplary shaking device. The rotary actuator 44, which can be powered pneumatically, electrically, or otherwise, can be used in a shaking device to shake the individual. An arm with a soft pad can be attached to the rotating shaft. A rotating angle may be adjusted by moving mechanical stops at the end of the actuator. Speed of rotation may be controlled with a flow control valve. Soft stops or dampers may be used to provide a smooth end of stroke operation.

Figure 5:
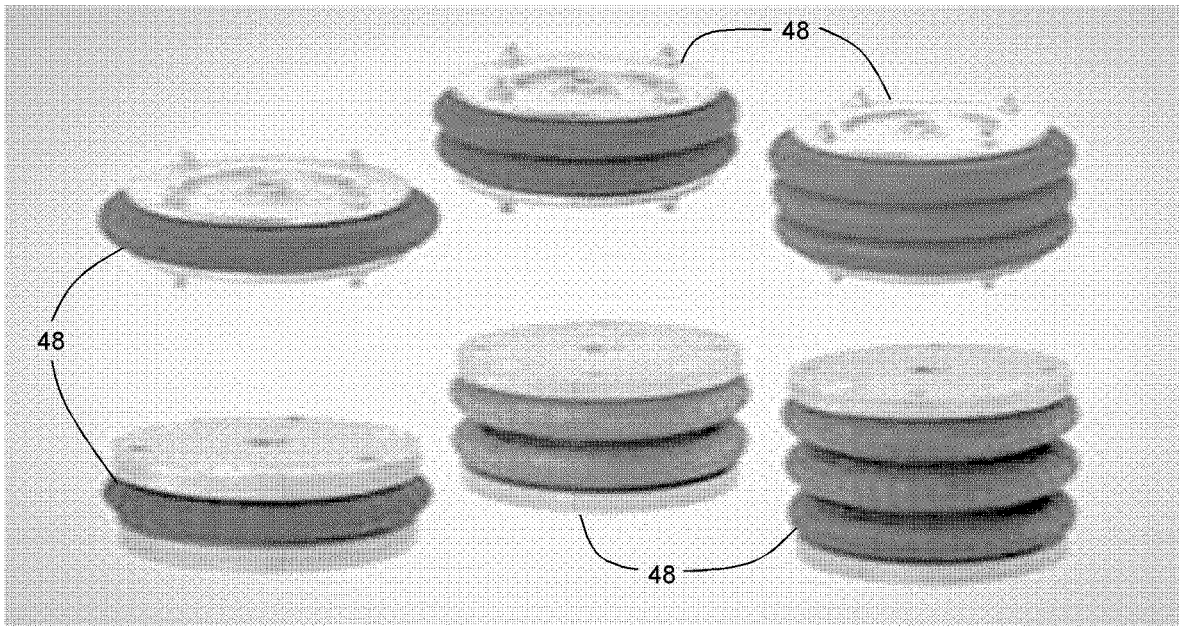
FIG. 5 is an orthogonal view of several bellows suitable for use in a shaking device.

FIG. 5 is a view showing several bellows 48 suitable for use in another exemplary shaking device. The bellows can be used in a shaking device to shake the individual. The bellows may be pneumatically powered or otherwise powered. In the case of a pneumatically powered device, changing an input air pressure may change a force applied by the bellows 48.

The stroke can be limited by the amount of air supplied into the bellows, mechanical limiters, or otherwise.

The motion on the individual is from side-to-side in some examples, but may be other motions or may use different angles. The amplitude or force involved may be sufficient for the medical procedure, but may be selected to not harm or to minimize harm to the individual.

Figure 8:
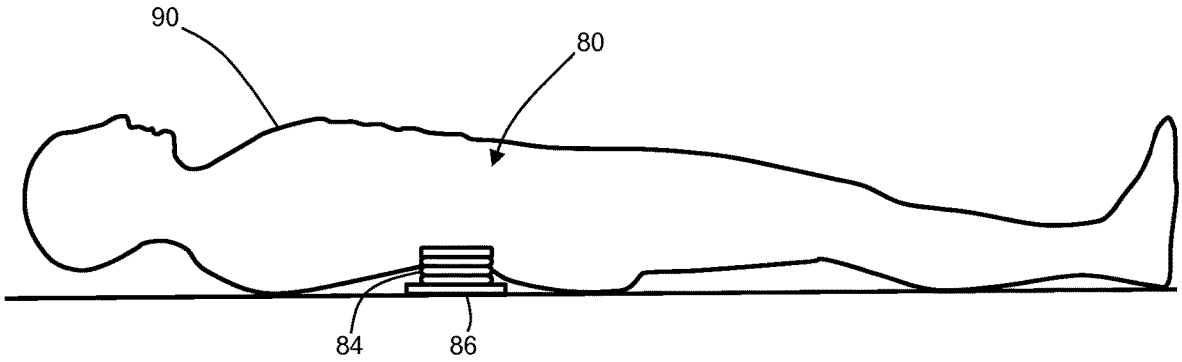
FIG. 8 is a schematic side view of a shaking device according to another embodiment of the present disclosure.
Figure 9:
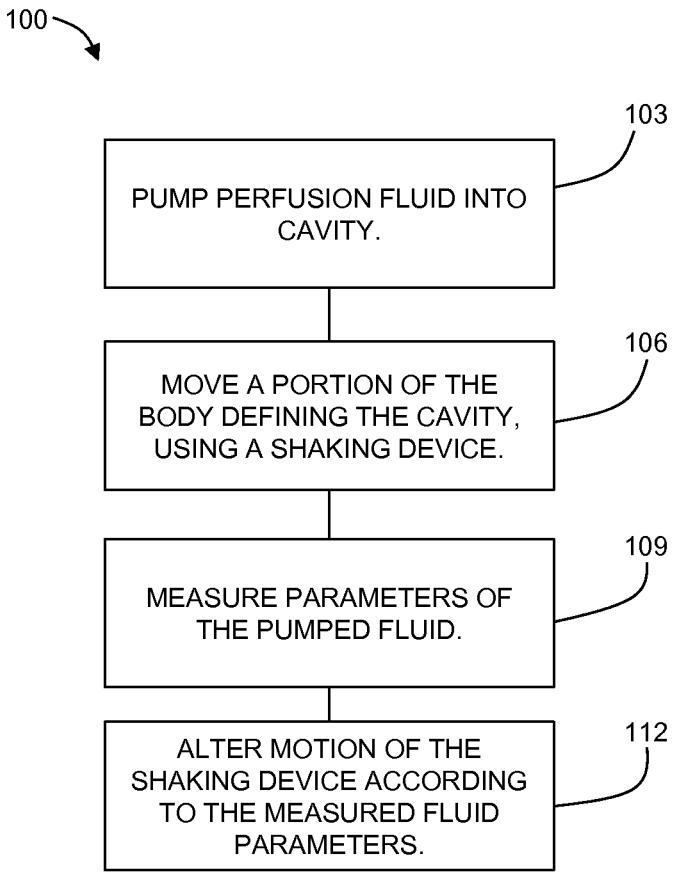
FIG. 9 depicts a method according to another embodiment of the present disclosure.

In another example, the shaking device may comprise two movers, for example, bellows, each mover positioned beneath a side of the individual, where the individual is supine. For example, FIG. 8 shows a shaking device 80 positioned under the torso of an individual 90 in a supine position. Such a shaking device 80 may include two bellows-type movers 84 (only one visible in side view) on the mount 86. In such an embodiment, alternate actuation of the movers 84 could be configured to cause a side-to-side movement of fluid in the abdomen of the individual.

A controller can be used to control the shaking device. For example, a programmable logic controller (PLC) with a control panel (for example, a touch screen, independent switches, etc.) may be used. In this manner, a set of pneumatic on/off valves, relays, flow control valves, and/or other actuation devices are connected between the PLC and the mover. By changing the values in the control panel, the PLC will actuate the mover accordingly.

The settings may remain constant during a procedure or may be adjustable from one or more pre-set baseline settings. The user may change or adjust inputs or settings on the shaking device at any point during the procedure. For example, force, rhythm, stroke length, speed (extending and retracting), and/or other parameters can be adjusted. In some embodiments, a shaking device can automatically change or adjust inputs or settings based on readings from other medical devices through a feedback system. In one example, the shaking device may provide regular pushing with an adjustable speed or pattern.

Figure 6:
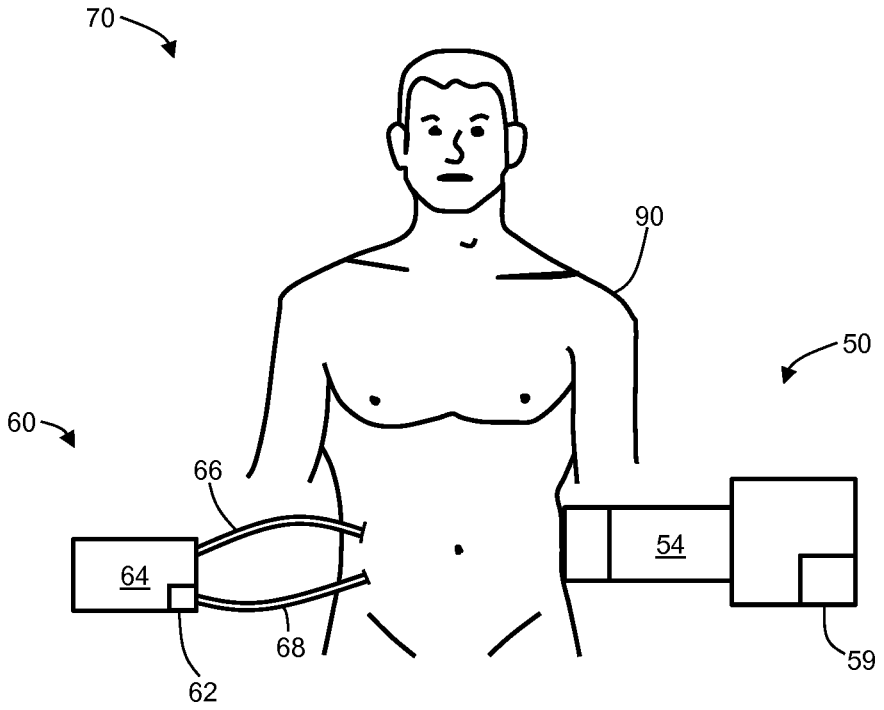
FIG. 6 is schematic view a system according to an embodiment of the present disclosure.

The use of a feedback system with a shaking device can optimize treatment for different individuals. The body of each individual is unique, and the feedback system can monitor readings to change the settings of the shaking device to improve treatment of the individual. For example, FIG. 6 depicts an embodiment wherein a shaking device 50 is part of system 70 having a bypass perfusion machine 60 configured in a feedback loop with the shaking device 50. For example, the bypass perfusion machine 60 may have a pump 64 for circulating fluid, an inflow catheter 66 for providing fluid to the cavity from the pump 64, and an outflow catheter 68 for returning fluid form the cavity to the pump 64. One or more sensors 62 may be provided for measuring perfusion parameters of the fluid. For example, a sensor(s) 62 may be configured for measuring fluid flow, fluid temperature, and/or fluid pressure.

The shaking device 50 of such a system 70 comprises a controller 59 which is in electronic communication with the sensor(s) 62. The controller is configured to control the movement of the mover 54. In this way, a feedback loop may be created by which movement of the shaking device 50 is controlled based on perfusion parameters measured by the sensor(s) 62. Such a feedback loop may enable, for example, the frequency or pattern of the shaking to be titrated.

The shaking device may be external to the body. In other embodiments, the shaking device also can be used for other procedures inside the body. In some respects, a shaking device according to embodiments of the present disclosure may be considered as moving a cavity, for example, a cavity of an individual.

The shaking device described herein provides multiple advantages. The shaking device can deliver a specified amount of force with its shaking movements or can deliver a shaking movement at a specified rate, speed, or rhythm. The shaking device can avoid interruptions or irregularities that may occur if a surgeon is performing the procedure. The shaking device avoids surgeon fatigue and reduces the number of surgical personnel needed in the operating room to replace a resting surgeon. The feedback associated with the shaking device can tailor or optimize treatment to individual individuals.

While described with respect to a bypass perfusion machine used for treating peritoneal carcinomatosis, the shaking device disclosed herein can be used for other medical procedures. Peritoneal carcinomatosis is merely listed as an example.

While this device is described with respect to humans, it is not so limited. The device also can apply in a veterinary setting to other mammals or animals.

While surgeons are described as using this shaking device, other physicians or veterinarians also may use this shaking device.

The present disclosure may be embodied as a method 100 for providing a perfusion fluid (such as, for example, a fluid chemotherapeutic agent) to a cavity, or, more particularly, to an individual. The method 100 comprises pumping 103 the perfusion fluid into the cavity at a first location and receiving the fluid from the cavity at a second location. The fluid may be provided and received in a closed loop as is known in the art, where the received fluid is recirculated back to the cavity. The method 100 comprises using a shaking device to move 106 at least a portion of the cavity (for example, by moving a portion of the body defining the cavity) to cause movement of the fluid while in the cavity. The movement 106 may be continual for a period of time while the fluid is in the cavity. Parameters of the pumped fluid are measured 109, for example, the temperature of the fluid, the flow rate into the cavity, the flow rate out of the cavity, etc. As further described above, a controller is used to alter 112 parameters of the shaking device, according to the measured parameters of the pumped 103 perfusion fluid, thereby causing a change in the movement of the body defining the cavity. For example, the shaking device may be reconfigured by the controller to cause a more or less forceful movement, quicker or slower movement, larger or smaller movement, etc.

Although the present disclosure has been described with respect to one or more particular embodiments, it will be understood that other embodiments of the present disclosure may be made without departing from the spirit and scope of the present disclosure. Hence, the present disclosure is deemed limited only by the appended claims and the reasonable interpretation thereof.

What is claimed is:

1. A shaking device, comprising:

at least one moving pad;

a mover configured to reciprocally move the moving pad; and a mount configured to support the mover;

wherein the shaking device is configured to be connected to a bypass perfusion machine used for chemotherapy treatment using a feedback system, and wherein the mover is configured to change settings based on readings from the feedback system;

wherein the shaking device is connected to the bypass perfusion machine, wherein the readings comprise at least one of an input flow, an output flow, and a liquid temperature, and wherein the settings comprise one or more of force, rhythm, stroke length, extending speed, and retracting speed.

2. The shaking device of claim 1, wherein the mover comprises a slide actuator, cylinder actuator, rotary actuator, or a bellows.

3. The shaking device of claim 1, wherein the pad is configured to shake, press, push, or agitate a part of a human body.

4. The shaking device of claim 1, wherein the pad is configured to shake or agitate an entirety of a human body.

5. The shaking device of claim 1, wherein the mount is configured to be connected to a bed.

6. The shaking device of claim 1, wherein the mount is a stand.

7. The shaking device of claim 1, wherein the pad is configured to be strapped to an individual.

8. The shaking device of claim 1, further comprising a cushion disposed on the pad.

* * * * *